United States Patent [19]

Colwell et al.

[11] 4,334,730

[45] Jun. 15, 1982

[54] INSULATED FROM GROUND BULKHEAD ADAPTER

[75] Inventors: William L. Colwell, Norwalk; Carl W. Schmelzle, Westport, both of Conn.

[73] Assignee: Bunker Ramo Corporation, Oak Brook, Ill.

[21] Appl. No.: 97,459

[22] Filed: Nov. 26, 1979

[51] Int. Cl.[3] ..... H01R 13/40

[52] U.S. Cl. ..... 339/130 C; 339/218 R

[58] Field of Search ..... 339/94 A, 126, 128, 339/129, 130, 177, 218

[56] References Cited

U.S. PATENT DOCUMENTS

| | | | |
|---|---|---|---|
| 1,483,218 | 2/1924 | Fahnestock | 338/128 |
| 2,258,738 | 10/1941 | Buchanan | 339/218 R |
| 3,067,974 | 12/1962 | Baldwin | 339/126 R |
| 3,076,169 | 1/1963 | Blaisdell | 339/89 |
| 3,111,356 | 11/1963 | Mazzagatti et al. | 339/154 |
| 3,142,721 | 7/1964 | Long | 174/65 |
| 3,277,423 | 10/1966 | Rose | 339/91 |
| 3,319,211 | 5/1967 | Smith et al. | 339/31 |
| 3,678,444 | 7/1972 | Stevens et al. | 339/130 C |
| 3,681,739 | 8/1972 | Kornick | 339/94 C |
| 3,915,539 | 10/1975 | Collins | 339/94 C |
| 3,936,132 | 2/1976 | Hutter | 339/130 C |
| 4,108,529 | 8/1978 | Evans | 339/177 R |

FOREIGN PATENT DOCUMENTS

| | | | |
|---|---|---|---|
| 1162441 | 2/1964 | Fed. Rep. of Germany | 339/177 R |
| 1300249 | 6/1962 | France | 339/177 R |
| 753240 | 7/1956 | United Kingdom | 339/126 RS |

OTHER PUBLICATIONS

Amphenol Minature Connectors, Min-2 Series Catalogue, p. 12.

Catalogue of Trompeter Electronics Inc., Chatsworth, Ca.

Bunker Ramo Amphenol RF Product News; 6-1975.

*Primary Examiner*—Joseph H. McGlynn

*Attorney, Agent, or Firm*—Dale A. Kubly; John R. Hoffman

[57] ABSTRACT

A coupling suited for insulated from ground mounting through an opening in a panel. The coupling includes an outer shell dimensioned and shaped to extend through the opening in the panel. The outer shell has an interruption in the outer surface thereof. The interruption is located intermediate the ends of the outer shell. An insulated mounting member is provided which is associated with the outer shell. The insulated mounting member is disposed intermediate the ends of the outer shell and is dimensioned and shaped such that at least a portion thereof extends through the opening in the panel. The insulated mounting member cooperates with the interruption so as to be in integral relationship with the outer shell. The coupling is suitably manufactured by molding the insulated mounting member about the outer shell. With these features of construction, the coupling is adapted for insulated from ground mounting through an opening in a panel.

17 Claims, 7 Drawing Figures

50
50'
52
52'
54
54'
56
56'
58
58'
60
60'
62
62'
64
64'
66
66'
66a
66a'
66b
66b'
68
68'
70
72
72'
74'
76
76'
78
78'
80
80'
82'
5
7

INSULATED FROM GROUND BULKHEAD ADAPTER

BACKGROUND OF THE INVENTION

The present invention relates to an improved coupling suited for insulated from ground mounting through an opening in a panel and, more particularly, to an improved coaxial coupling utilizing an integral insulated mounting member and an improved method of manufacturing a coaxial coupling.

In existing coaxial couplings including connectors and adapters suited for mounting on a panel, the outer conductive shell of the coupling commonly serves as a conductive body. Thus, when the outer conductive shell is mounted in a panel of conductive material, the outer conductive shell, being in electrical contact with the panel, is normally shorted to ground (or to whatever other potential the panel may be at). However, there are applications where the shorting to ground of the outer conductive shell cannot be tolerated.

For these applications, various techniques have been developed for insulating the outer conductive shell from the panel. The most common technique presently utilized to insulate a coupling is to insert an insulated bushing between the outer conductive shell or coupling body and the panel. This method also requires that an additional insulating washer be added between the lock washer or nut utilized for securing the coupling to the panel. Another technique which may be utilized to isolate the coupling from the panel, i.e., ground, is to mount an insulating sleeve over the outer conductive shell or coupling body in a fashion whereby the sleeve is the only element which makes contact with the panel, the locking nut, etc., when the coupling is mounted in the panel.

While the techniques indicated above provide an insulated from ground panel or bulkhead coupling, they suffer from a number of substantial shortcomings. First, when an insulated from ground coupling is utilized in place of a standard panel coupling, at least one, and sometimes two, extra parts are required. These additional parts must be handled and assembled on the coupling when the coupling is mounted. Thus, because of these extra parts, the insulated coupling is significantly more expensive to manufacture and utilize than standard panel couplings.

Second, the extra washer, sleeve flanges, or other elements required for insulating the coupling from the panel have a finite thickness which means that, for a given size coupling, the maximum panel thickness which can be accommodated is reduced.

Third, the addition of a bushing or sleeve on the coupling increases the diameter required for the mounting hole. This means that the panel will have to be repunched, or otherwise operated on to increase the hole size in the event that standard size mounting holes have already been punched in the panel, and the increased size required for the holes also reduces the density of couplers which may be accommodated on a given panel. Moreover, the reduction in panel thickness and in the amount of material between mounting openings combine to reduce the strength of the mounting panel.

In summary, it is seen that standard insulated from ground panel couplings are significantly more expensive to manufacture and utilize than standard panel couplings in that (1) they require additional parts; (2) the additional parts must be assembled, increasing the assembly costs; and (3) either standard size mounting openings must be enlarged, possibly requiring the purchase of special tooling to perform this function, or an inventory must be maintained of panels having two different size mounting holes.

From the above, it is apparent that a requirement exists for a panel coupling such as an adapter or a connector having a conductive body or shell which may be easily insulated from ground without resulting in any increase either in the size of the coupling or in the cost of manufacturing and assembling it.

SUMMARY OF THE INVENTION

In accordance with the above, this invention provides a coupling suited for insulated from ground mounting through an opening in a panel. The coupling includes an outer shell dimensioned and shaped to extend through the opening in the panel. The outer shell has an interruption in the outer surface thereof. The interruption is located intermediate the ends of the outer shell. An insulated mounting member is provided which is associated with the outer shell. The insulated mounting member is disposed intermediate the ends of the outer shell and is dimensioned and shaped such that at least a portion thereof extends through the opening in the panel. The insulated mounting member cooperates with the interruption so as to be in integral relationship with the outer shell. The coupling is suitably manufactured by molding the insulated mounting member about the outer shell. With these features of construction, this invention overcomes the deficiencies heretofore existing in insulated from ground panel couplings.

More specifically, the present invention is directed to a coaxial coupling such as an adapter or a connector. The coupling will then include a dielectric member disposed in the outer conductive shell and having a passageway extending therethrough. A contact is suitably disposed in the passageway in the dielectric member. It is also a feature of the invention that the insulated mounting member include means associated therewith for securing the coupling in insulated from ground relationship to the panel. The coupling will then suitably include a threaded outer surface on the insulated mounting member cooperably associated with a threaded inner surface of a nut. By providing the insulated mounted member with a shoulder portion having a dimension greater than the dimension of the opening in the panel, the nut secures the coupling insulated from ground relationship to the panel in cooperation with the insulated mounting member.

In one preferred embodiment, the outer shell is generally cylindrical in shape and the interruption is a cylindrical undercut in the outer shell. The cylindrical undercut advantageously has a knurled surface or a plurality of longitudinal slots cooperating with the insulated mounting member. Moreover, the cylindrical undercut suitably defines a pair of speed shoulders and the insulated mounting member is suitably disposed within the cylindrical undercut between the spaced shoulders. The insulated mounting member is generally cylindrical in shape and advantageously includes a longitudinally extending flattened surfaced portion for keying into a "D" hole in a panel. In another preferred embodiment, the interruption includes at least one opening extending through the outer shell such that the insulated mounting member is integral in the area of the opening with the dielectric member.

In accordance with the structural features, this invention is also directed to a method of manufacturing a coaxial coupling such as an adapter or a connector suited for insulated from ground mounting through an opening in a panel. The method includes the step of providing an outer conductive shell dimensioned and shaped to extend through the opening in the panel. The outer conductive shell has either an interruption about the outer surface thereof or an opening extending therethrough. The interruption or opening is located intermediate the ends of the outer conductive shell. The method also includes the step of molding an insulated mounting member about the outer conductive shell in the area of the interruption or the opening intermediate the ends of the outer conductive shell. With these features, the method successfully provides a coaxial coupling of the type described in a highly satisfactory manner.

In one preferred form, the insulated mounting member is molded about the outer conductive shell in the area of the interruption so as to have a dimension and shape permitting at least a portion of the insulated mounting member to extend through the opening in the panel. The method then also includes the step of inserting a dielectric member having a passageway extending therethrough into the outer conductive shell and inserting a contact into the passageway in the dielectric member. In another preferred form, the insulated mounting member is molded about the outer conductive shell in the area of the opening and a contact is supported within the outer conductive or shell so that the dielectric member can be molded at the same time about the contact within the outer conductive shell. The method is then characterized by the insulated mounting member having a dimension and shape permitting at least a portion thereof to extend through the opening in the panel with the dielectric member having a diameter and shape so as to maintain the contact in a selected position within the outer conductive shell. In the latter preferred form, the dielectric member and the insulated mounting member are molded as a single integral dielectric structure extending through the opening in the outer conductive shell.

The foregoing and other objects, features, and advantages of the invention will be apparent from the following more particular description of the preferred embodiments of the invention as illustrated in the accompanying drawings.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings. In the drawings, like reference numerals identify like elements in the several figures in which:

DETAILED DESCRIPTION OF THE PREFERRED EMBODIMENT

Figure 2:
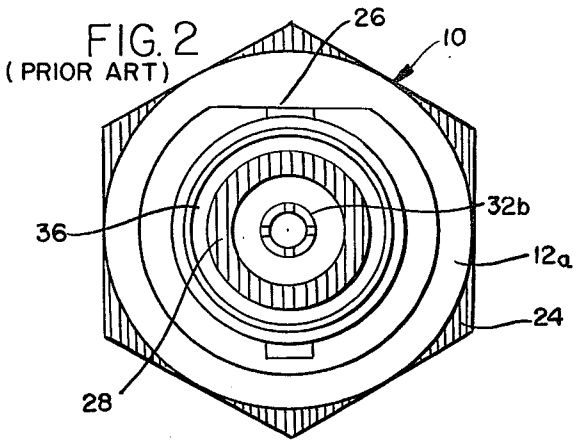
FIG. 2 (PRIOR ART)
FIG. 2 is an end view of the grounded panel adapter of FIG. 1.
Figure 1:
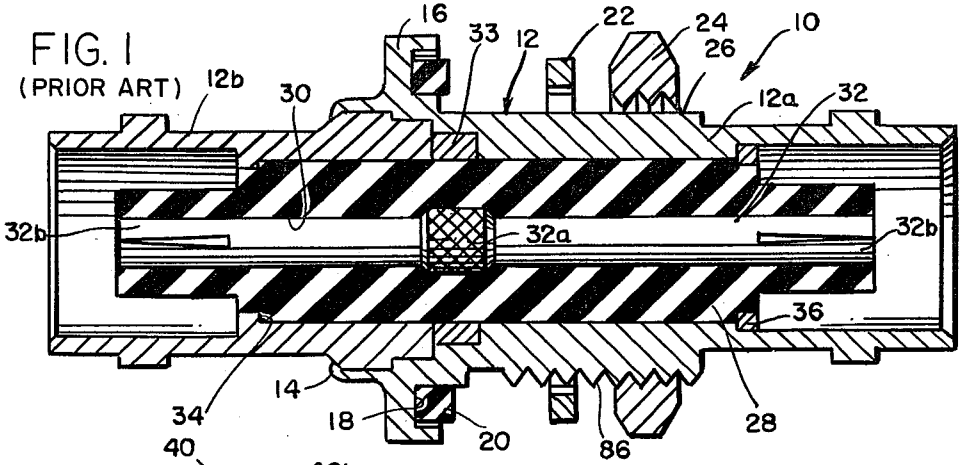
FIG. 1 (PRIOR ART)
FIG. 1 is a sectional view of a prior art construction of a grounded panel adapter.

In the illustration given and with reference first to FIG. 1, a prior art construction of grounded panel coupling 10 is shown. The coupling 10 includes a conductive body 12 defined by first and second body segments 12A and 12B. The first and second body segments are joined as at 14 by staking and soldering. The body portion 12A includes a circumferential flange 16 having a recessed circumferential groove 18 therein. The recessed circumferential groove 18 receives a circumferential gasket 20. The circumferential gasket 20 cooperates with a lock washer 22 and a hex nut 24 for mounting the coupling 10 through an opening in a panel. As will be appreciated by referring to FIG. 2, the coupling 10 advantageously includes a flattened portion 26 in the body portion 12A adapting the body portion 12A for insertion through a "D" hole in a panel.

Referring again to FIG. 1, the coupling 10 illustrated is a BNC single hole grounded panel adapter having two female ends. This adapter is sold by the assignee of the present invention, Bunker Ramo Corporation, under the part designation "Amphenol 4525". The adapter further includes a dielectric member or insulator 28 having a central passageway 30 therethrough for receiving a contact 32. The contact 32 has a center knurled portion 32A to aid in retaining the contact within the dielectric member or insulator 28 and female contact portions 32B on opposite ends thereof. The dielectric member or insulator 28 is retained in position within the conductive body 12 by means of an annular shoulder 34 and a retaining ring 36. The adapter 10 also includes a ring 38 to provide an environmental seal. This adapter is merely illustrative of those sold by the assignee of the present invention, Bunker Ramo Corporation, and others in the field of grounded panel adapters. As will be appreciated by those skilled in the art, the adapter 10 is presented herein merely for purposes of illustrating a representative form of grounded panel adapter.

As discussed hereinabove, prior art constructions of insulated from ground panel couplings have presented various problems. It is believed that reference to FIG. 3 will illustrate those problems. The adapter there shown is essentially identical in construction to the adapter 10 illustrated in FIG. 1 with the exception of the addition of an insulating bushing 40 and an insulating washer 42. The insulating bushing 40 includes a ring portion 40A surrounding a portion of the outer surface of the conductive body portion 12A and an outwardly extending flange portion 40B. The ring portion 40A is required to insulate the conductive body portion 12A from the panel. The insulating bushing 40 requires, as a result, a larger opening in the panel. The adapter 10' also reduces the maximum panel thickness which can be accommodated. It is believed that referring to FIG. 3 will clearly illustrate this due to the finite thickness of the insulating bushing 40 and the insulating washer 42. As will be appreciated from FIG. 3, the insulated from ground panel adapter 10' is significantly more expensive to manufacture and utilize than standard panel adapters in that (1) it requires additional parts; (2) the additional parts must be assembled, increasing the assembly cost; and (3) either standard size mounting openings must be enlarged, possibly requiring the purchase of special tooling to perform this function, or an inventory must be maintained of panels having two different size mounting holes.

Figure 3:
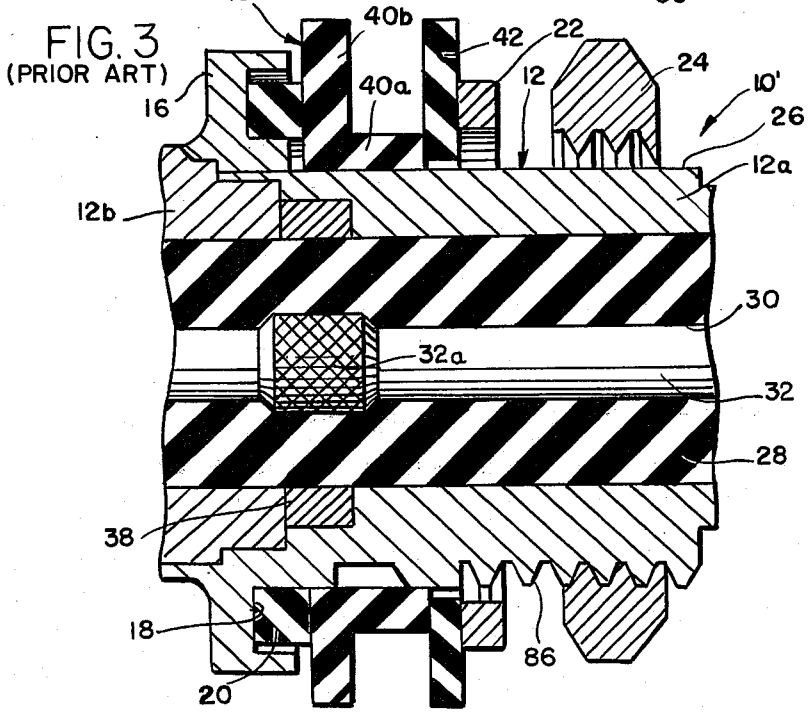
FIG. 3 (PRIOR ART)
FIG. 3 is a partial sectional view of a prior construction of an insulated from ground panel adapter.

In contrast to the grounded panel adapter 10 and the insulated from ground panel adapter 10' illustrated in FIGS. 1 and 3, respectively, the insulated from ground coupling of the present invention is illustrated in FIGS. 4 through 7.

Figures 4, 6, 7:
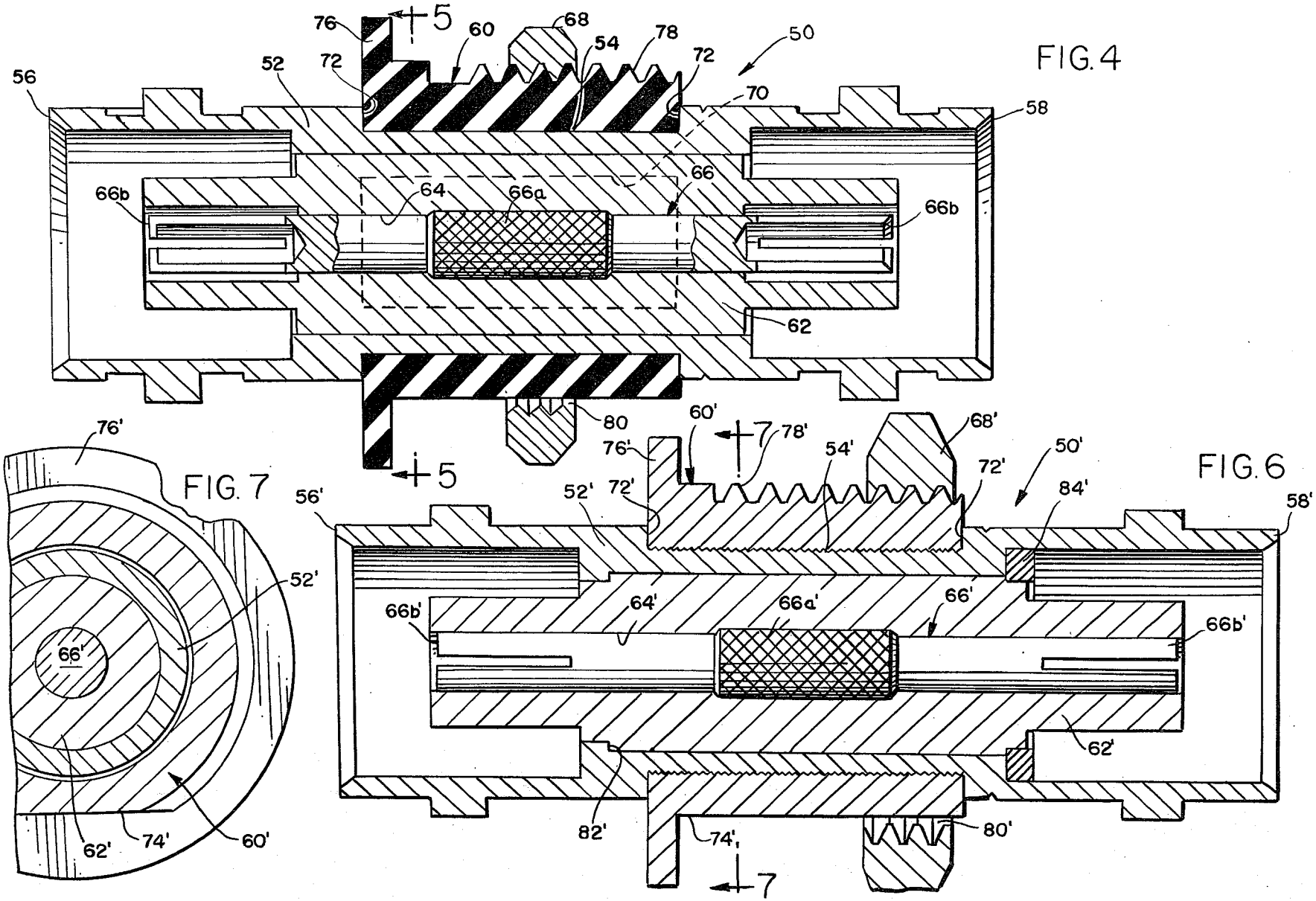
FIG. 4 is a sectional view of an insulated from ground panel coupler in accordance with one embodiment of the present invention.
FIG. 6 is a sectional view of an insulated from ground panel coupler in accordance with another embodiment of the present invention.
FIG. 7 is a sectional view taken on the line 7—7 of FIG. 6.

Referring first to FIG. 4, a coupling 50 suited for insulated from ground mounting through an opening in a panel is illustrated. The coupling 50 includes an outer conductive shell 52 dimensioned and shaped to extend through the opening in the panel. The outer conductive shell 52 has an interruption (as at 54) in the outer surface thereof. The interruption 54 is located intermediate the ends 56 and 58 of the outer conductive shell 52. An insulated mounting member 60 is associated with the outer conductive shell 52. The insulated mounting member 60 is disposed intermediate the ends 56 and 58 of the outer conductive shell 52 and is dimensioned and shaped such that at least a portion thereof will extend through an opening in a panel. The insulated mounting member 60 cooperates with the interruption 54 so as to be in integral relationship with the outer conductive shell 52. With these features of construction, the coupling 50 is well suited for insulated from ground mounting through an opening in a panel.

In a more specific sense, the present invention is directed to a coaxial coupling such as an adapter of a connector. The coaxial coupling 50 includes a dielectric member 62 disposed in the outer conductive shell 52 and having a passageway 64 extending therethrough. A contact 66 is disposed in the passageway 64 in the dielectric member 62. The coaxial coupling 50 also includes means 68 associated with the insulated mounting member 60 for securing the coupling in insulated from ground relationship to a panel. With these features of construction, the coupling 50 represents a significant advancement over prior art structures such as illustrated in FIG. 3.

Figure 5:
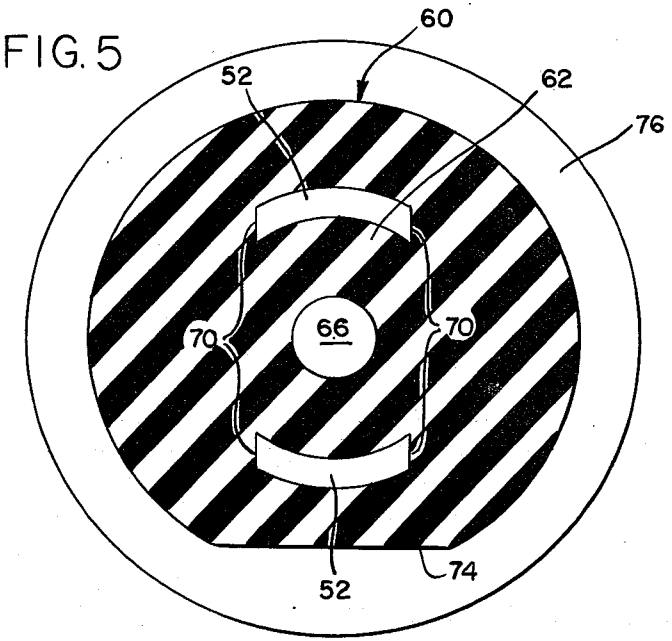
FIG. 5 is a sectional view taken on the line 5—5 of FIG. 4.

More specifically, the coupling 50 preferrably includes the outer conductive shell 52 being generally cylindrical in shape (as shown in FIG. 5) with the interruption 54 being a cylindrical undercut in the outer conductive shell 52. The interruption 54 in the embodiment illustrated in FIG. 4 includes at least one, and preferably a pair, of openings 70 extending through the side of the outer conductive shell 52. The openings 70 extend longitudinally of the outer conductive shell 52 and are disposed on opposite sides thereof. The interruption 54 in the embodiment illustrated in FIG. 4 also defines a pair of spaced shoulders 72. As will be appreciated, the insulated mounting member 60 is disposed within the cylindrical undercut 54 between the spaced shoulders 72.

Referring again to FIG. 5, the insulated mounting member 60 is generally cylindrical in shape and includes a longitudinally extending flattened surface portion 74. It will also be appreciated that the insulated mounting member 60 is integral in the area of the openings 70 with the dielectric member 62. The insulated mounting member 60 includes a shoulder portion 76 having a dimension greater than the dimension of the opening in the panel into which the coupling 50 is to be mounted in insulation from ground relationship. It will further be appreciated that the insulated mounting member 60 has a threaded outer surface (as at 78) cooperating with the coupling securing means 68. More specifically, the coupling securing means 68 includes a nut having a threaded inner surface 80 engageable with the threaded outer surface 78 of the insulated mounting member 60.

Referring to FIG. 6, an alternative embodiment of coupling 50' is illustrated. The coupling 50' again includes an outer conductive shell 52', an interruption 54', an insulated mounting member 60', a dielectric member 62', a passageway 64', contact 66', and coupling securing means 68'. However, the alternative embodiment of coupling 50' includes one important distinction.

More particularly, the coupling 50' includes a continuous or solid outer conductive shell 52' in the area of the interruption 54'. It will be appreciated that there are no openings or "windows" as provided in the embodiment illustrated in FIG. 4. The outer surface of the interruption or cylindrical undercut 54' in FIG. 6 is, instead, either knurled (as shown in FIG. 6) or provided with a plurality of longitudinal slots, either of which cooperate with the insulated mounting member 60' to restrain it against rotational movement relative to the outer conductive shell 52'. It will be appreciated that the insulated mounting member 60 is not integral with the dielectric member 62' as in the embodiment illustrated in FIG. 4. Otherwise, the couplings illustrated in FIGS. 4 and 6 are substantially identical.

Referring to additional details of the embodiment illustrated in FIG. 6, the interruption 54' is located intermediate the ends 56' and 58' of the outer conductive shell 52'. The interruption or cylindrical undercut 54' defines a pair of spaced shoulders 72' with the insulated mounting member 60' being disposed within the cylindrical undercut 54' between the spaced shoulders 72'. The insulated mounting member 60' is generally cylindrical in shape and includes a longitudinally extending flattened surface portion 74'. The interruption or cylindrical undercut 54' cooperates with the shoulder 72' to restrain the insulated mounting member 60' against longitudinal movement relative to the outer conductive shell 52'. Additionally, the insulated mounting member 60' includes a shoulder portion 76' having a dimension greater than the dimension of an opening in a panel in which the coupling 50' is to be mounted in insulated from ground relationship.

Additional common features of the coupling 50' with the coupling 50 includes a threaded outer surface 78' on the insulated mounting member 60'. It will also be appreciated that the coupling securing means or nut 68' has a threaded inner surface 80' engageable with the threaded outer surface 78' of the insulated mounting member 60'. With these common features of construction, the couplings 50 and 50' are equally well suited for insulated from ground mounting through an opening in a panel.

Referring once again to FIG. 4, the contact 66 includes a knurled portion 66A and female contact portions 66B on opposite ends thereof. The knurled portion 66A cooperates with the surface of the dielectric member defining the passageway 64 to retain the contact 66 in position against relative rotational and longitudinal movement. It will be appreciated that the integral nature of the insulated mounting member 60 and the dielectric member 62, which can suitably be molded at the same time and are integral through the openings or "windows" 70, prevent any unwanted movement of the dielectric member 62 within the outer conductive shell 52. The opposite ends 56 and 58 of the outer conductive shell 52 are adapted to receive coaxial connectors in conventional fashion. Of course, where the contact 66 includes female contact portions 66B (as in FIG. 4) the connectors provided for mating with the coupler 50 will carry suitable mating male contact members.

As shown in FIG. 4, the coupling 50 is a BNC jack-to-jack adapter. It will be appreciated by those skilled in the art that this is merely illustrative of one of many applications to which the present invention can be applied. More particularly, the coupler 50 could also be, for example, a connector member suited for insulated from ground mounting through an opening in a panel.

Referring once again to FIG. 6, the same condition holds true. Namely, it will be appreciated by those skilled in the art that the coupling 50' could not only be a BNC jack-to-jack adapter but it also could be any other form of adapter or simply a connector member suited for insulated from ground mounting through an opening in a panel. Moreover, the inventive concept is broadly applicable to any type of coupling.

As shown in FIG. 6, the contact 66' includes a knurled portion 66A' and female contact portions 66B' at opposite ends thereof. The knurled portion 66A' cooperates with the surface of the dielectric member 62' defining the passageway 64' to restrain the contact 66' against axial and rotational movement. The dielectric member 62' is secured in position by means of an annular shoulder 82' and a retaining ring 84'. The annular shoulder 82' and the retaining ring 84' confine the dielectric member 62' against axial movement relative to the outer conductive shell 52'. Moreover, the dielectric member 62' can be tightly fitted within the outer conductive shell 52' to restrict or limit rotational movement.

Of course, the opposite ends 56' and 58' of the outer conductive shell 52' are adapted for receiving suitable mating connector members. Since the coupling 50' is an adapter having female contact portions 66B', the mating connector members will suitably carry male contact portions adapted for mating engagement with the female contact portions 66B'. However, the coupling 50' has been shown in the form of an adapter merely for purposes of illustrating the inventive concepts.

In addition to the structure described in detail hereinabove, a method of manufacturing a coaxial coupling suited for insulated from ground mounting through an opening in a panel has been developed. The method includes the step of providing an outer conductive shell dimensioned and shaped to extend through the opening in the panel and having an interruption about the outer surface thereof located intermediate the ends of the outer conductive shell. The method also includes the step of inserting a dielectric member having a passageway extending therethrough into the outer conductive shell and inserting a contact into the passageway in the dielectric member. The method further includes the step of molding an insulated mounting member about the outer conductive shell in the area of the interruption so as to have a dimension and shape permitting at least a portion of the insulated mounting member to extend through the opening in the panel. Referring to FIG. 6, the inventive method will be more fully appreciated.

Referring to FIG. 4, an alternative method of manufacturing a coaxial coupling suited for insulated from ground mounting through an opening in a panel has also been developed. The method again includes the step of providing an outer conductive shell dimensioned and shaped to extend through the opening in the panel but with the outer conductive shell having at least one opening extending therethrough. A contact is then supported within the outer conductive shell and an insulated mounting member is molded about the outer conductive shell in the area of the opening while at the same time a dielectric member is molded about the contact within the outer conductive shell. The method also includes the step of molding the insulated mounting member so as to have a dimension and shape permitting at least a portion thereof to extend through the opening in the panel. Moreover, the dielectric member suitably has a dimension and shape so as to maintain the contact in a selected position within the outer conductive shell with the dielectric member and the insulated mounting member being molded as a single integral dielectric structure extending through the opening in the outer conductive shell.

Referring to FIGS. 4 and 6, it will be appreciated by those skilled in the art how the present invention accomplishes the objective of providing a coupling suited for insulated from ground mounting through standard sized openings in a panel. This can best be accomplished by considering the coupling illustrated in FIG. 1. More particularly, it will be appreciated that the coupling 10 illustrated in FIG. 1 utilizes an enlarged diameter portion of the outer conductive shell 12 in the area of the external threads 86 which is done, in part, to provide additional strength in the area where the coupling 10 is secured to a panel by means of the nut 24. This enlarged area has been eliminated in the couplings illustrated in FIGS. 4 and 6. In fact, the enlarged area has been replaced by cylindrical undercuts 54 and 54' to permit molding of the insulated mounting members 60 and 60' so as to have a diameter in the area of the threads 78 and 78' no larger than the diameter of the outer conductive shell 12 in the area of the threads 86 of the coupling 10 illustrated in FIG. 1.

With the present invention, a coupling suited for insulated from ground mounting through an opening in a panel has been successfully provided. The coupling can be formed of the same physical size as a grounded coupling, no additional parts are required to insulate the coupling from ground, the coupling utilizes the same mounting hole as a grounded coupling, no additional assembly time for the coupling will be required, and the coupling may well be less costly than prior art solutions. Moreover, a versatile method of manufacturing a coupling suited for insulated from ground mounting through an opening in a panel has also been provided.

While in the foregoing specification a detailed description of the invention has been set forth for purposes of illustration, the details herein given may be varied by those skilled in the art without departing from the spirit and scope of the invention as defined by the appended claims.

We claim:

1. A coupling for insulated from ground mounting through an opening in a panel, comprising:

an outer shell dimensioned and shaped to extend axially through said opening in said panel, said outer shell having an interruption in the outer surface thereof, said interruption being located intermediate the ends of said outer shell and being defined by an undercut dimensioned to span said panel opening with opposed axially spaced facing shoulders on opposite sides of the opening; and means for mounting said outer shell to said panel in insulated from ground relationship, said mounting means being disposed in said undercut between said opposed shoulders and being dimensioned and shaped such that at least a portion thereof extends through said opening in said panel, said mounting means thereby cooperating with said interruption so as to be in integral relationship with said outer shell.

2. The coupling as defined in claim 1 wherein said undercut includes at least one opening extending through said outer shell.

3. The coupling as defined in claim 1 wherein said outer shell is generally cylindrical in shape, said interruption being a cylindrical undercut in said outer shell.

4. The coupling as defined in claim 3 wherein said cylindrical undercut has a knurled surface cooperating with said mounting means.

5. The coupling as defined in claim 3 wherein said cylindrical undercut has a plurality of longitudinal slots cooperating with said mounting means.

6. A coaxial coupling for insulated from ground mounting through an opening in a panel, comprising:

an outer conductive shell dimensioned and shaped to extend axially through said opening in said panel, said outer conductive shell having an interruption in the outer surface thereof, said interruption being located intermediate the ends of said outer conductive shell and being defined by an undercut dimensioned to span said panel opening with opposed axially spaced facing shoulders on opposite sides of the opening;

a dielectric member disposed in said outer conductive shell, said dielectric member having a passageway extending therethrough;

a contact disposed in said passageway in said dielectric member;

an insulated mounting member associated with said outer conductive shell, at least a portion of said insulated mounting member being dimensioned and shaped to extend through said opening in said panel, said insulated mounting member being disposed in said undercut between said shoulders to thereby cooperate with said interruption in said outer conductive shell so as to be in integral relationship therewith; and means associated with said insulated mounting member for securing said coupling in insulated from ground relationship to said panel.

7. The coaxial coupling as defined in claim 6 wherein said undercut includes a pair of openings, said openings extending longitudinally of said outer conductive shell and being disposed on opposite sides thereof.

8. The coaxial coupling as defined in claim 6 wherein said insulated mounting member is generally cylindrical in shape, said insulated mounting member including a longitudinally extending flattened surface portion.

9. The coaxial coupling as defined in claim 6 wherein said insulated mounting member includes a shoulder portion having a dimension greater than the dimension of said opening in said panel.

10. The coaxial coupling as defined in claim 6 wherein said undercut includes at least one opening extending through said outer conductive shell, said insulated mounting member being integral in the area of said opening with said dielectric member.

11. The coaxial coupling as defined in claim 6 wherein said outer conductive shell is generally cylindrical in shape, said interruption being a cylindrical undercut in said outer conductive shell.

12. The coaxial coupling as defined in claim 11 wherein said cylindrical undercut has a knurled surface cooperating with said insulated mounting member.

13. The coaxial coupling as defined in claim 11 wherein said cylindrical undercut has a plurality of longitudinal slots cooperating with said insulated mounting member.

14. The coaxial coupling as defined in claim 6 wherein said insulated mounting member has a threaded outer surface, said threaded outer surface cooperating with said coupling securing means.

15. The coaxial coupling as defined in claim 14 wherein said coupling securing means includes a nut having a threaded inner surface engageable with said threaded outer surface of said insulated mounting member.

16. A method of manufacturing a coaxial coupling for insulated from ground mounting through an opening in a panel comprising the steps of:

providing an outer conductive shell dimensioned and shaped to extend axially through said opening in said panel, said outer conductive shell having an interruption about the outer surface thereof, said interruption being located intermediate the ends of said outer conductive shell and being defined by an undercut dimensioned to span said panel opening with opposed axially spaced facing shoulders on opposite sides of the opening;

molding an insulated mounted member about said outer conductive shell in the area of said undercut and between said opposed shoulders and with a dimension and shape permitting at least a portion of said insulated mounting member to extend through said opening in said panel; and inserting a dielectric member having a passageway extending therethrough into said outer conductive shell and inserting a contact into said passageway in said dielectric member.

17. A method of manufacturing a coaxial coupling for insulated from ground mounting through an opening in a panel comprising the steps of:

providing an outer conductive shell dimensioned and shaped to extend axially through said opening in said panel, said outer conductive shell having an interruption about the outer surface thereof defined by an undercut with opposed axially spaced facing shoulders and at least one opening extending therethrough, said interruption and said opening being located and axially dimensioned to at least span the opening in said panel;

supporting a contact within said outer conductive shell; and molding an insulated mounting member about said outer conductive shell in the area of said undercut between said opposed shoulders and in the area of said shell opening, and at the same time molding a dielectric member about said contact within said outer conductive shell;

said insulated mounting member having a dimension and shape permitting at least a portion thereof to extend through said opening in said panel, said dielectric member having a dimension and shape so as to maintain said contact in a selected position within said outer conductive shell, said dielectric member and said insulated mounting member being molded as a single intergral dielectric structure extending through said opening in said outer conductive shell to axially locate and hold the dielectric member relative to the insulated mounting member and, in turn, locate and hold the mounting member on the shell relative to the panel opening.

* * * * *